United States Patent [19]

Johannisson et al.

[11] 4,186,582

[45] Feb. 5, 1980

[54] PRESS FOR HYDROSTATIC EXTRUSION OF TUBES AND PROFILES

[75] Inventors: Tom Johannisson; Kai Nilsson; Rolf Sjöblom; Marja Widell, all of Västerås, Sweden

[73] Assignee: ASEA Aktiebolag, Vasteras, Sweden

[21] Appl. No.: 870,735

[22] Filed: Jan. 19, 1978

[51] Int. Cl.[2] ..... B21B 22/10

[52] U.S. Cl. ..... 72/60; 72/43; 260/420

[58] Field of Search ..... 72/60, 41, 42, 43; 260/419, 420

[56] References Cited

U.S. PATENT DOCUMENTS

| | | | |
|---|---|---|---|
| 2,401,340 | 6/1946 | Dunmire | 72/43 |
| 3,580,019 | 5/1971 | Beresener et al. | 72/47 |
| 3,926,023 | 12/1975 | Hayaslie | 72/60 |

*Primary Examiner*—Leon Gilden

*Attorney, Agent, or Firm*—Watson, Cole, Grindle & Watson

[57] ABSTRACT

The pressure medium used in the pressure chamber of a hydrostatic press is degassified in a degassing tank prior to delivery to the pressure chamber so as to improve the resistance of the pressure cylinder, or the liner inside of the pressure cylinder, to fatigue. The degassified pressure medium can be a mixture of recirculated pressure medium recovered after passage through the die extrusion hole and new pressure medium, such as castor oil.

10 Claims, 2 Drawing Figures

PRESS FOR HYDROSTATIC EXTRUSION OF TUBES AND PROFILES

BACKGROUND OF THE INVENTION

In the hydrostatic extrusion of a billet of a metallic material, the billet is surrounded by a pressure medium which exerts the required pressure on the billet such that the material of the billet is pressed out through the die of the press to form a tube or rod-like product. The presses which are normally used in this connection comprise a pressure chamber for the pressure medium, composed of a high-pressure cylinder, a die arranged in one opening of the high-pressure cylinder for forming the material of the billet, and a punch insertable into the other opening in the high-pressure cylinder for generation of the necessary pressure in the pressure medium. The high-pressure cylinder is subjected internally to very great and highly varying stresses, which leads to fatigue of the portion of the high-pressure cylinder located nearest to the pressure chamber. The high-pressure cylinder is therefore normally constructed with an internal liner in the form of a tube which is exchangeable and can therefore be replaced with a new liner when consumed through fatigue breakdown, or when fatigue breakdown may be expected. To make the liner as resistant as possible to stresses, it is normally manufactured from a high-tensile steel, and it is usually highly prestressed utilizing the surrounding parts of the high-pressure cylinder. The pressure medium which is most used is castor oil, which, besides a good lubricating effect, has the advantage that the viscosity is changed to a relatively small extent with the pressure. For supplying pressure medium to the pressure chamber, the chamber is provided with with an inlet for pressure medium.

SUMMARY OF THE INVENTION

According to the present invention, it has been found to be possible to considerably improve the resistance of the liner to fatigue, thus considerably extending the life of the liner. If no liner is used, it is possible in a corresponding way to improve the resistance of the high-pressure cylinder itself to fatigue. According to the invention, the improved results are obtained by connecting the pressure medium inlet of the pressure chamber to a degassing device, in which the pressure medium can be degassed before it is supplied to the pressure chamber.

More particularly, the invention relates to a press for hydrostatic extrusion of tubes and profiles of metallic material comprising a pressure chamber which is defined by a high-pressure cylinder, a die sealing one opening of the cylinder and having an opening for shaping a tube or a profile, and a punch, insertable into the other opening of the cylinder for generating a pressure and which is necessary for extrusion of a billet of the metallic material. The pressure is generated within a pressure medium contained in the pressure chamber and which surrounds the billet, which pressure medium consists of castor oil or another organic ester with lubricating effect and which can be supplied to the pressure chamber through an inlet, the improvement wherein in that the inlet for the pressure medium is connected to a degassing device for the pressure medium.

The present invention is particularly designed to be used in the extrusion of billets of copper and copper alloys, particularly if they are preheated to at least 200° C. It affords advantages also in the extrusion of billets of other metallic materials, such as, among other things, aluminium and aluminium alloys, particularly if preheated to at least 200° C.

A collecting vessel for pressure medium used in the press is suitably connected to the inlet side of the degassing device, and a collecting vessel for pressure medium degassed in the degassing device is suitably connected to the outlet side of the degassing device. The last-mentioned vessel is preferably closed from the surrounding atmosphere, suitably by filling a space above the pressure medium with nitrogen gas or another gas which is inert towards the pressure medium. The degassing device is normally arranged in a circulating circuit for the pressure medium, which comprises, in addition to the collecting vessels, a filter for removing solid particles from the pressure medium, and a pump.

DESCRIPTION OF THE DRAWINGS

The invention will be explained in greater detail by way of examples with reference to the accompanying drawings, in which.

DESCRIPTION OF THE PREFERRED EMBODIMENT

Figure 1:
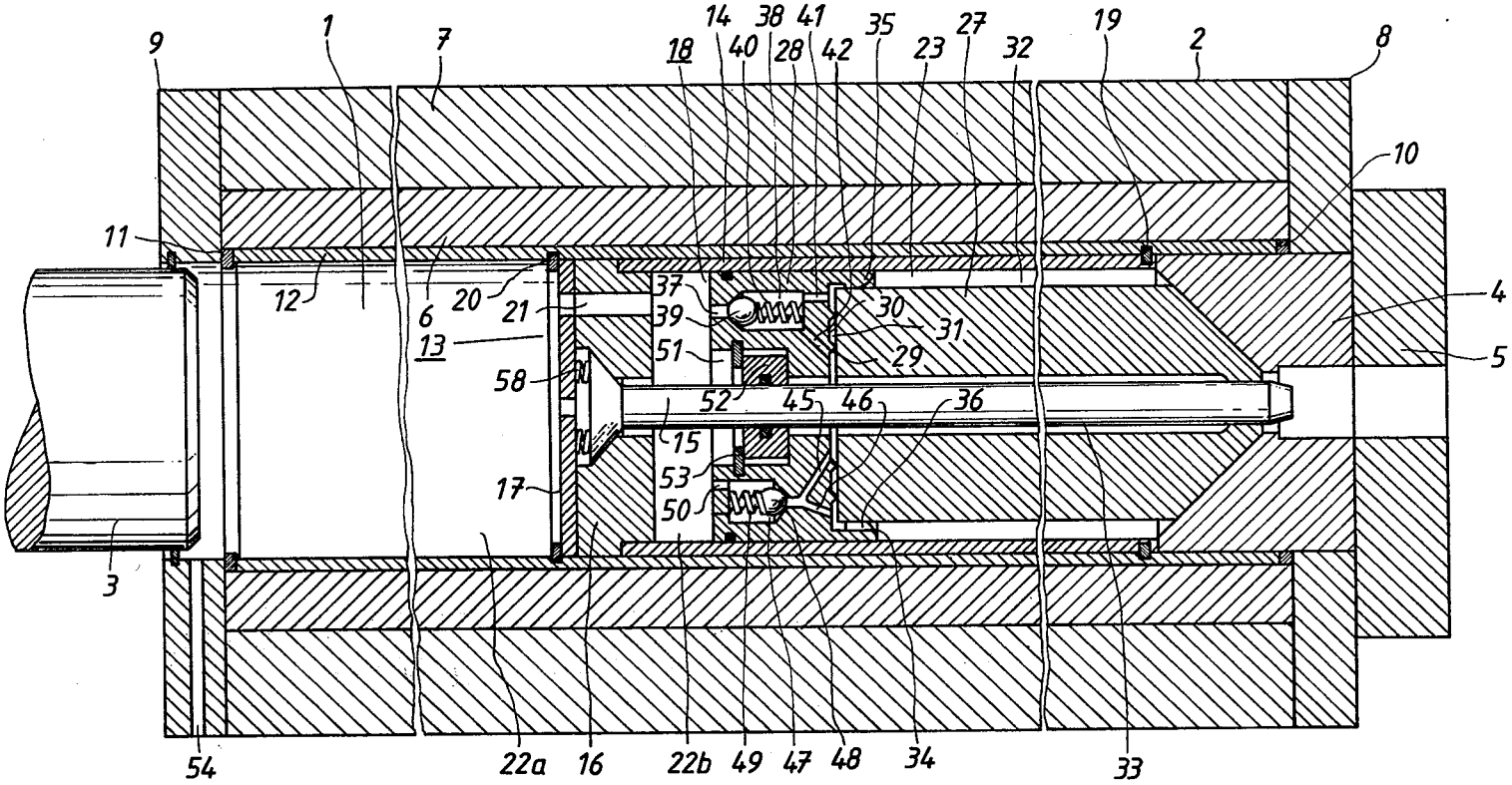
FIG. 1 shows a prior art press for manufacturing tubes, to which the present invention may be applied, and FIG. 2 a degassing device which is connected to such a press in accordance with the present invention.

In the press shown in FIG. 1, 1 designates a pressure chamber which is defined by a high-pressure cylinder 2, a pressure-generating punch 3 and a die 4 resting on a die support 5. The cylinder 2 may be built up from an inner tube 6 which is surrounded by an outer tube 7, possibly a prestressed strip sheath (not shown), and is provided with end pieces 8 and 9. The inner tube acts as liner and is replaceable. It is normally manufactured from a high-tensile steel. The end pieces constitute supports for seals 10 and 11 between which there is a spacing tube 12. Inside the high-pressure cylinder there is a unit 13, which consists of a spacing tube 14, a mandrel 15, a plate 16 which transmits forces from the mandrel to the spacing tube, a lid 17 and springs 58 which fix the mandrel to the plate 16, as well as a billet holder 18 which is axially movable inside tube 14 and along mandrel 15. It centres the mandrel 15. During the pressing, the mandrel force is transferred through plate 16 and tube 14 to die 4. During the remaining parts of a working cycle, unit 13 is axially fixed by locking rings 19 and 20 in tube 12. There is a certain axial clearance. A channel 21 passes through lid 17 and plate 16.

Billet holder 18 divides the pressure chamber 1 into two spaces 22 and 23. Space 22 between pressure-generating punch 3 and billet holder 18 is divided into two parts **22*a* and 22*b* by plate 16. In space 23 between billet holder 18 and die 4 there is a billet 27. The billet holder contains a part 28 with two annular bars 29 and 30 which seal against the end surface of billet 27 and define a space 31 from gaps 32 and 33 between billet 27 and tube 14 and mandrel 15, respectively. The billet holder is also provided with a guide means 34 with bars 35 for centering billet 27 and with grooves 36. Billet holder 18 contains a forward flow path for pressure medium, which consists of channel 37, valve housing 38 with a valve member 39 and a valve spring 40, and channels 41 and 42. At a pressure difference between the two sides of the billet holder determined by the valve member 39, the flow path allows pressure medium to flow from space 22***b* to gaps 32 and 33. There is also a return flow path which consists of channels 45 and 46, valve housing 47 with valve member 48 and spring 49, and channel 50, this flow path permitting pressure medium to flow in the opposite direction when the volumes of the gaps are reduced during the pressing. In the billet holder portion 28 there is a bore 51 in which there is arranged a bushing 52 which is axially fixed by a locking ring 53. Between the bore and the bushing there is a clearance so that bushing 52 is able to move radially in relation to the billet holder portion 28. 54 indicates an inlet for the supply of pressure medium, in the exemplified case consisting of castor oil, to the pressure chamber.

When billet 27 is placed in high-pressure cylinder 2, the high-pressure cylinder is displaced from the stationary die support 5, that is to the left in the figure, to a sufficient extent for the billet to be placed in position. In the exemplified case, the billet consists of copper or copper alloy with a temperature of about 550° C. Also die 4, suitably also heated, is applied in position on the billet before the high-pressure cylinder and the punch are displaced in a direction towards the die support to the position shown in the figure. The castor oil is then supplied through inlet 54 to space 22. The pressure in the castor oil is sufficiently high for the castor oil to be forwarded to different parts of the space 23. The castor oil enters between tubes 12 and 6 and between tubes 14 and 12. The pressing out of a tube of the billet through die 4 is accomplished by displacing punch 3 in a direction towards the die. During such displacement, inlet 54 is closed for the castor oil. When the pressing is finished, the castor oil flows out outside the end piece 8.

Figure 2:
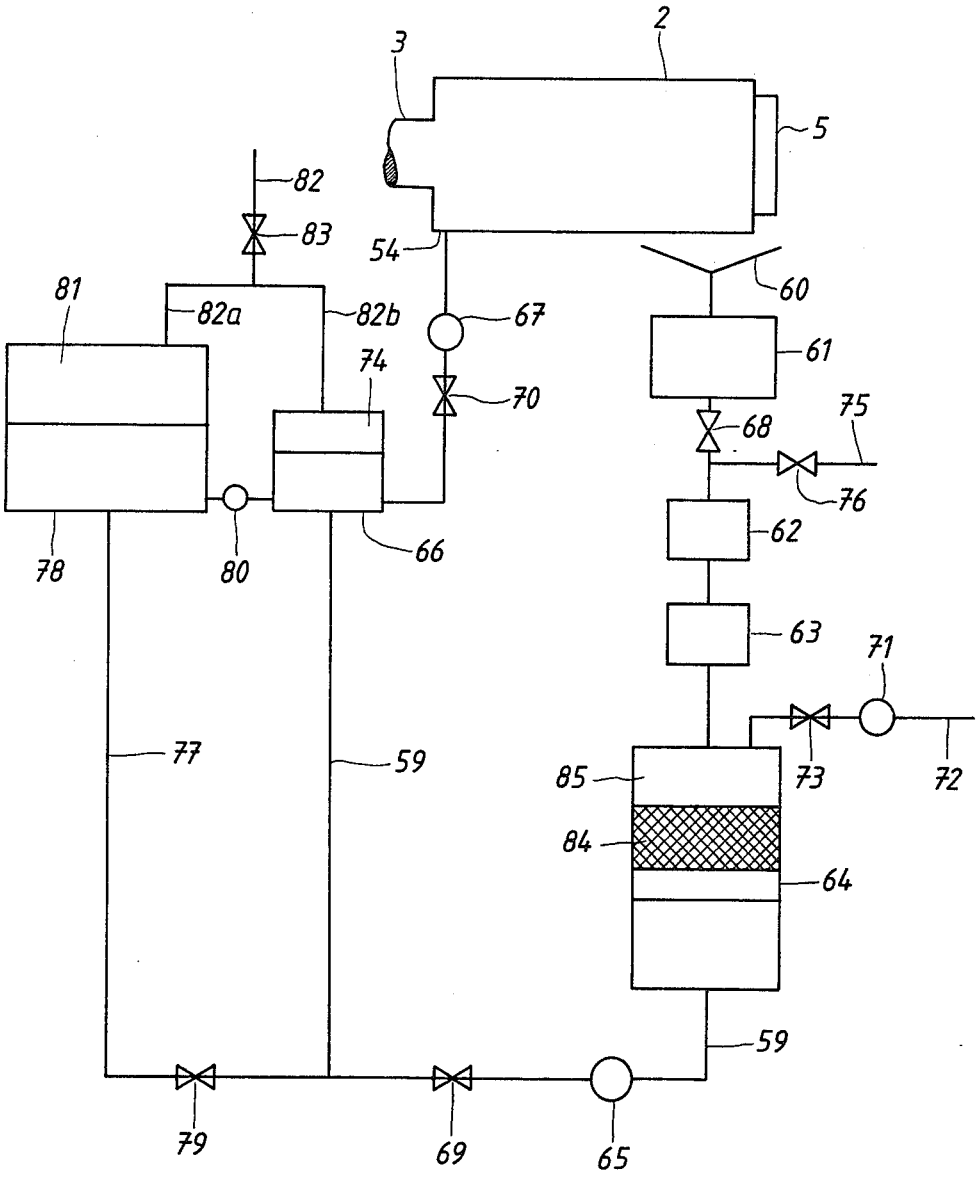

The degassing device which is connected to the press according to FIG. 1 and which is illustrated in FIG. 2 is part of a circulation circuit 59 for the castor oil, comprising a trough 60 placed below the press, in which castor oil used in the press is collected, a collecting vessel 61 for storing the castor oil, a heating device 62 for possible heating of the castor oil, a filter 63 for removing solid particles, a degassing tank 64 for degassing the castor oil, a pump 65, a collecting vessel 66 for degassed castor oil, a further pump 67 and a number of valves 68, 69 and 70 by which the flow of the castor oil can be regulated as well as opened and closed. The outlet side of the circulation circuit is connected to inlet 54 for the pressure medium in the pressure chamber of the press. The degassing tank 64 contains a filling 84 of Raschig rings or similar filling bodies to provide a large surface for the castor oil rilled down onto the filling bodies from above. The castor oil is maintained at such a level in the degassing tank that the upper part constitutes a space 85 which is free from liquid. A vacuum pump 71 is connected to this space 85 by which a pressure of 1 torr can be maintained. The vacuum pump is included in conduit 72 with valve 73. A suitable temperature of the castor oil during degassing is 70° C. Space 74 above the degassed liquid in the collecting vessel 66 is filled with nitrogen gas.

Because of unavoidable losses of castor oil during the pressing, fresh castor oil must be supplied to the circulation circuit at certain times. This can be done, for example, through a conduit 75 with a valve 76. It can also be appropriate to store a reserve of degassed castor oil in a branch pipe 77 to the circulation circuit. The branch pipe comprises, besides collecting vessels 78, a valve 79 and a pump 80. Like vessel 66, vessel 78 is suitably filled with nitrogen gas in space 81 above the level of the castor oil. The nitrogen gas can be supplied to the vessels through a conduit 82 (82*a*, 82*b*) with the valve 83.

The measures taken to prevent fatigue of the lining 6 in the press, illustrated in FIG. 2, can of course be employed in other presses for pressing tubes, as well as in presses for pressing rods. Presses used in the latter case are considerably simpler since they do not comprise any mandrel, nor the other parts of unit 13.

The present invention may be applied not only when using castor oil as pressure medium, but also when using other pressure mediums consisting of an organic ester with lubricating effect, such as soy bean oil, mixtures of castor oil or soy bean oil with cocoa-nut oil and esters of pentaerythritol, trimethylol propane or neopentyl glycol and caproic acid, caprylic acid, capric acid, pelargonic acid or their isomers.

We claim:

1. An apparatus for the hydrostatic extrusion of tubes and profiles of metallic material which comprises means forming an elongated high-pressure hollow cylinder forming a pressure chamber therein, said high-pressure cylinder having opposed open ends;

means forming a die having an extrusion hole therein positioned in one of the open ends of said cylinder to sealingly close said open end;

punch means positioned in the other of the open ends of said cylinder and able to move in the elongation direction of said cylinder and thereby generate a pressure within a pressure medium contained in said pressure chamber, which pressurized pressure medium is then able to extrude a billet of metallic material contained in said pressure chamber through said extrusion hole; said pressure medium being prevented from exposure to the atmosphere;

conduit means for supplying pressure medium directly to said pressure chamber, and degassing means connected to said conduit means, said degassing means capable of degassing a pressure medium supplied to said degassing tank and thus to said conduit means and said pressure chamber.

2. The apparatus of claim 1 wherein said conduit means includes means forming an inlet passageway in said cylinder, and a means forming a closed passageway from said degassing means to said inlet passageway means.

3. The apparatus of claim 2 including a recirculation system for returning pressure medium from the outlet end of the extrusion hole in said die means to said degassing means, said recirculation system including A trough means positioned below the extrusion hole in said die means for recovery of pressure medium which escapes through said extrusion hole.

4. The apparatus of claim 3 wherein said recirculation system also includes a first collecting vessel positioned to communication with said trough means and said degassing means, such that it accepts pressure medium from said trough and delivers pressure medium to said degassing means.

5. The apparatus of claim 3 wherein a second collecting vessel is positioned in said closed passageway means between said degassing means and said inlet passageway means, such that it accepts degassed pressure medium from said degassing means and delivers degassed pressure medium to said inlet passageway means.

6. The apparatus of claim 3 wherein said degassing means comprises a degassing tank containing Raschig rings.

7. The apparatus of claim 6 wherein a vacuum pump means is connected to an upper part of said degassing tank.

8. The apparatus of claim 3 wherein means for introducing fresh pressure medium is connected to said recirculation system between said trough and said degassing tank.

9. The apparatus of claim 1 wherein said pressure medium comprises an organic ester having a lubricating effect.

10. The apparatus of claim 9 wherein said pressure medium consists of castor oil.

* * * * *